United States Patent [19]

Iwahara et al.

[11] 4,060,696

[45] Nov. 29, 1977

[54] BINAURAL FOUR-CHANNEL STEREOPHONY

[75] Inventors: Makoto Iwahara; Fumio Maruyama; Goro Fujiki; Toshinori Mori; Norio Hiyama; Mitsuru Kikuchi, all of Yokohama, Japan

[73] Assignee: Victor Company of Japan, Limited, Japan

[21] Appl. No.: 697,122

[22] Filed: June 17, 1976

[30] Foreign Application Priority Data

June 20, 1975 Japan ..... 50-75209
June 24, 1975 Japan ..... 50-76934

[51] Int. Cl.[2] ..... H04R 5/00
[52] U.S. Cl. ..... 179/1 GQ; 179/100.4 ST
[58] Field of Search ..... 179/1 GQ, 1 G, 100.1 TD, 179/100.4 ST

[56] References Cited

U.S. PATENT DOCUMENTS

| | | | |
|---|---|---|---|
| 1,624,486 | 4/1927 | Fletcher et al. | 179/1 G |
| 2,481,911 | 9/1949 | Boer et al. | 179/1 G |
| 3,083,264 | 3/1963 | Wintringham | 179/100.4 ST |
| 3,478,167 | 11/1969 | Sorkin | 179/1 G |
| 3,710,034 | 1/1973 | Murry | 179/1 G |
| 3,985,960 | 10/1976 | Wallace | 179/1 G |

*Primary Examiner*—Douglas W. Olms
*Attorney, Agent, or Firm*—Robert E. Burns; Emmanuel J. Lobato; Bruce L. Adams

[57] ABSTRACT

A binaural four-channel stereophony comprises at least two dummy heads each provided with microphones at the ears of the dummy to pick up signals from various sound sources or groups of sound sources. The binaural signals representing each sound source or a group of sound sources are coupled to an acoustic crosstalk cancellation circuit and eventually applied to two front or two rear loudspeakers. Each sound source or group of sound sources is localized between adjacent ones of the four speakers to simulate the binaural effect produced in a closed-circuit type binaural sound reproducing system.

11 Claims, 11 Drawing Figures

S1a S2a S3a
SOUND SOURCES
2
1a
3L
3R
4La
4Ra
Rsa
15a
51a
Lsa
16a
52a
8f
13f
5
17a
53a
9f
10f
14f
TRANSDUCER
40
18a
54a
13r
11f
12f
M
11r
12r
S1b
1b
8r
10r
9r
14r
SOUND SOURCE
4Lb
4Rb
Rsb
15b
51b
Lsb
16b
52b
17b
53b
41
18b
54b
1C
4Lc
4Rc
Rsc
15c
51c
Lsc
16c
52c
17c
53c
18c
54c
S1c S2c S3c
SOUND SOURCES

BINAURAL FOUR-CHANNEL STEREOPHONY

BACKGROUND OF THE INVENTION

The present invention relates generally to stereophony, and in particular to four-channel stereophony using binaural signals generated from microphones mounted in dummy heads simulating the human head.

The known binaural sound recording system, is a closed circuit type of sound reproducing system in which two microphones, used to pick up the original sound, are each connected to two independent corresponding transducing channels which, in turn, are coupled to two independent corresponding earphones worn by the listener. The microphones are mounted in a dummy simulating the human head in shape and dimensions and at the locations corresponding to the ears of the human head. The listener is transferred to the location of the dummy head by means of a two-channel sound reproducing system. Because of the direct transfer of signals, the listener has spatial impressions as if sitting at the location of the dummy. However, because of the inconvenience that the listener has to wear the earphones (headphones), two-channel loudspeaker reproduction using a dummy head has been proposed to take advantage of the spatial impressions of the binaural system. However, a stereophonic pair of signals is usually reproduced by two loudspeakers standing on the right and left in front of the listener. The listener then receives at his left ear not only the wanted left signal, but an unwanted right signal as a result of sound diffraction at the head. Because of the symmetry of the system, this process is called acoustical crosstalk. This acoustical crosstalk can be eliminated by an electronic circuit as proposed by P. Damaske (Head-Related Two-Channel Stereophony with Loudspeaker Reproduction, The Journal of the Acoustical Society of America, Vol. 50 No. 4 Part II pages 1109–1115). Reproducing the binaural signals of a dummy head with two loudspeakers is still problematic in that virtual sound sources can only be produced between the two loudspeakers and in that a slight movement of the listener's head gives him an impression that the sound sources have been dislocated.

SUMMARY OF THE INVENTION

Therefore, the primary object of the invention is to provide four-channel stereophony with loudspeaker reproduction in which at least two dummy heads are used to generate front and rear binaural sound signals to provide localization of virtual sound sources between four loudspeakers located around the listener.

A four-channel stereophony in accordance with a first aspect of the invention comprises first, second and third dummy heads each simulating the human head in shape and dimensions and provided with microphones mounted in positions corresponding to the ears of the human head to pick up front, lateral and rear sound sources, respectively. The signals representing the front and rear sound sources are applied to a first and a second acoustic crosstalk cancellation circuit, respectively, while the signals representing the lateral sound source are coupled through a pair of variable attenuators to the first and second cancellation circuits at an attenuation ratio determined by the direction of the lateral sound source from the location of the second dummy head. Sound sources are precisely localized between the four individual speakers.

A four-channel streophony in accordance with a second aspect of the invention comprises first and second dummy heads with microphones mounted therein. Both dummy heads have their faces oriented in the same direction with the second dummy located exactly behind the first dummy with a predetermined spacing therebetween and located in a sound field of the same sound sources. Preferably, the first and second dummy heads are separated by a partition to produce a sound separation effect so that the first dummy picks up primarily front sound sources and the second dummy picks up primarily rear sound sources. The signals derived from both dummy heads are coupled to a first and a second crosstalk cancellation circuit, respectively.

BRIEF DESCRIPTION OF THE DRAWINGS

The invention will be further described in detail by way of examples in conjunction with the accompanying drawings, in which.

DESCRIPTION OF THE PREFERRED EMBODIMENTS

Figure 1:
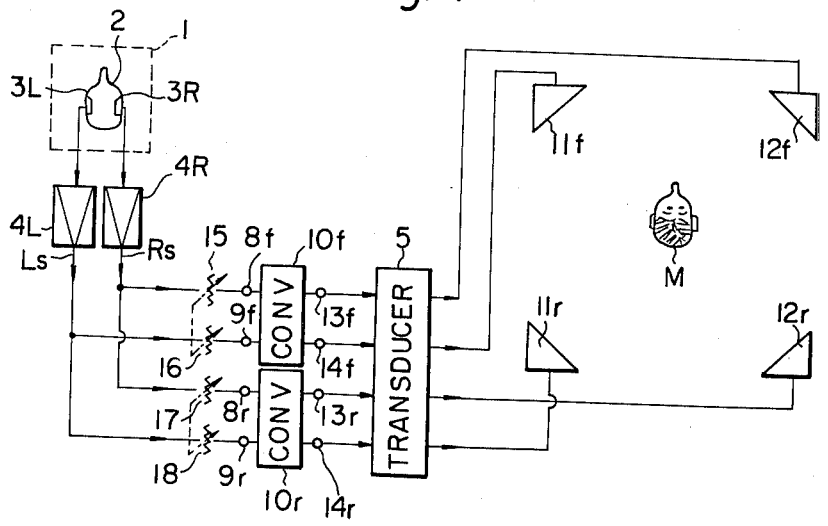
FIG. 1 is a schematic circuit diagram useful for describing the principle of the invention.

Before describing the embodiments of the present invention, reference is first had to FIG. 1 in which the principle of the invention is illustrated. A sound pickup arrangement 1 picks up binaural sound signals from an original sound source (not shown). Microphones 3R and 3L are mounted in a dummy 2 simulating the human head in shape and dimensions and at the locations corresponding to the ears of the human head. The sound signals are amplified through amplifiers 4R and 4L and applied to a front converter or compensator **10*f* and thence to a four-channel transducer 5. The amplified signals are also applied to a rear converter or compensator 10*r* and thence to the transducer 5. The transducer 5 may be an amplifier, a radio transmitter and receiver, a phonograph recorder or reproducer. Front loudspeakers 11*f* and 12*f* and rear speakers 11*r* and 12*r* are located in front and rear respectively of a listener M and connected to the outputs from the transducer 5. A set of ganged variable attenuators 15 and 16 is interposed in the circuit between the outputs from amplifiers 4R, 4L and the inputs to the converter 10*f*. Similarly, a set of ganged variable attenuators 17 and 18 is interposed between the amplifier outputs and the inputs to the rear converter 10*r*. In accordance with the invention, the front speakers 11*f* and 12*f* are used in the reproduction of the original sound sources located in front of the dummy head 2, while the rear speakers 11*r* and 12*r* are used in the reproduction of the original sound sources located rearward of the dummy head 2, and both front and rear sound channels are used simultaneously in the reproduction of the original sound located laterally of the dummy head. Localization of the original sound sources is achieved with reference to FIG. 4 which graphically illustrates the input gains of converters 10***f* and 10*r* as a function of direction of localization from the listener M in which arrows *a, b, c,* and *d* designate the directions toward speakers 11*f,* 12*f,* 11*r* and 12*r,* respectively.

Forward sound localization is achieved by adjusting the attenuators 15 and 16 to reduce their losses to provide a maximum input gain for the converter 10*f* as indicated by the arc of a solid-line curve which extends between lines *a* and *b,* while adjusting the attenuators 17 and 18 to maximize their losses to provide a minimum input gain for the converter 10*r* as indicated by the dotted-line curve. Conversely, rearward sound localization is achieved by adjusting the attenuators 17 and 18 to reduce their losses to provide a maximum input gain for the converter 10*r* as indicated by the arc of the dotted-line curve which extends between lines *c* and *d,* while adjusting the attenuators 15 and 16 to maximize their losses to provide a minimum input gain for the converter 10*f* as indicated by the solid-line curve. Localization of a sound source located laterally of the dummy head in a direction as indicated by arrow *e,* attenuators 15 to 18 are adjusted by the ratio of line segments on line *e* divided by the solid- and broken-line curves: in this case the attenuators 15 and 16 and attenuators 17 and 18 are adjusted such that the input gains for converters 10*f* and 10*r* are 60% and 40%, respectively, of the maximum level.

Under forward localization, the converter 10*f* provides cancellation of acoustic crosstalk resulting from sound diffraction at the head of the listener M. The converter 10*r* also provides crosstalk cancellation resulting from sound diffraction at the rear of the head of the listener M under rearward localization.

Right and left sound signals received at the ears of the listener M are expressed by the following Equation:

$$\begin{bmatrix} Le \\ Re \end{bmatrix} = A \cdot \begin{bmatrix} LsP \\ Rsp \end{bmatrix} \tag{1}$$

where, L*e* and R*e* are the sound signal levels at the left and right ears of the listener M, respectively, Lsp and Rsp are signal levels at the left and right loudspeakers 11*f* and 12*f,* respectively, and A is given by $$A = \begin{bmatrix} a_{11}\, a_{12} \\ a_{21}\, a_{22} \end{bmatrix} \tag{2}$$

where, $a_{11}$ is a transmission characteristic of sound from loudspeaker 11*f* to the left ear of listener, $a_{12}$, a transmission characteristic of sound from loudspeaker 12*f* of the left ear of the listener, $a_{21}$, a transmission characteristic of sound from loudspeaker 11*f* to the right ear of the listener, and $a_{22}$, a transmission characteristic of sound from loudspeaker 12*f* to the right ear of the listener.

Signals L*sp* and R*sp* have the following relation with the signals L*s* and R*s* delivered from amplifiers 3L and 3R, respectively:

$$\begin{bmatrix} Lsp \\ Rsp \end{bmatrix} = T \cdot A^{-1} \cdot \begin{bmatrix} Ls \\ Rs \end{bmatrix} \tag{3}$$

where, T is a delay time and $A^{-1}$ is an inverse matrix of A. By substituting Equation (3) into Equation (1), signals L*e* and R*e* are given by $$\begin{bmatrix} Le \\ Re \end{bmatrix} = A \cdot T \cdot A^{-1} \begin{bmatrix} Ls \\ Rs \end{bmatrix} = T \begin{bmatrix} Ls \\ Rs \end{bmatrix} \tag{4}$$

Equation (4) implies that the signals received by the ears of the listener M are the signals received at the ears of the dummy head 2 delayed by time T if the latter is converted in accordance with Equation (3). The conversion coefficient $T.A^{-1}$ is expressed by $$TA^{-1} = \frac{T}{a_{11} \cdot a_{22} - a_{12} \cdot a_{21}} \begin{bmatrix} a_{22} & -a_{12} \\ -a_{21} & a_{11} \end{bmatrix} \tag{5}$$

Figure 2:
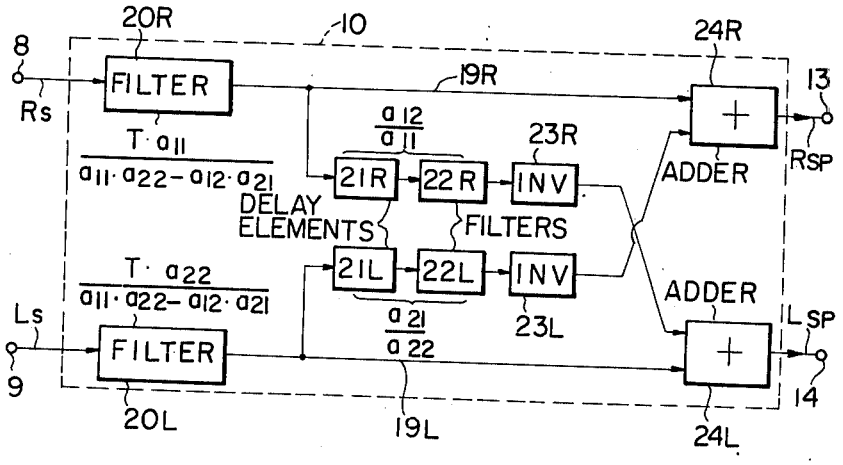
FIG. 2 is a detailed circuit diagram of an acoustic crosstalk cancellation circuit.

In FIG. 2, each of the front and rear converters 10*f* and 10*r* is shown and comprises a right channel 19R connected between the output of the amplifier 4R through input terminal 8 and an input of the transducer 5 through output terminal 13 and a left channel 19L connected between the output of amplifier 4L through input terminal 9 and an input of the transducer 5 through output terminal 14. A filter 20R having a transmission characteristic $$\frac{T \cdot a_{11}}{a_{11} \cdot a_{22} - a_{12} \cdot a_{21}}$$

is placed in the right channel 19R and a filter 20L having a transmission characteristic $$\frac{T \cdot a_{22}}{a_{11} \cdot a_{22} - a_{12} \cdot a_{21}}$$

is interposed in the left channel 19L. Numerals 21R and 22R are a delay element and a filter, respectively, to provide attenuation of signal on the right channel 19R by the factor of $a_{12}/a_{11}$. The delay element 21R and filter 22R are connected in series through an inverter 23R between the output of filter 20R and one input of an adder 24L connected in the left channel 19L. Similarly, the output from the filter 20L is attenuated by the factor of $a_{21}/a_{22}$ by series-connected delay element 21L and filter 22L connected between the output of fileter 20L and one input of an adder 24R connected in the right channel 19R through an inverter 23L. The output from the filter 20R is directly applied to the other input of the adder 24R to provide summation of the two input voltages to generate an output R*sp* which is given by $$Rsp = \frac{T\,(a_{11} - a_{21})}{a_{11} \cdot a_{22} - a_{12} \cdot a_{21}}\, Rs \tag{6}$$

Likewise, the output from the filter 20L is directly applied to the other input of the adder 24L so that adder 24L delivers an output L*sp* which is given by $$Lsp = \frac{T(a_{22} - a_{12})}{a_{11} \cdot a_{22} - a_{12} \cdot a_{21}} Ls \quad (7)$$

Figure 3A:
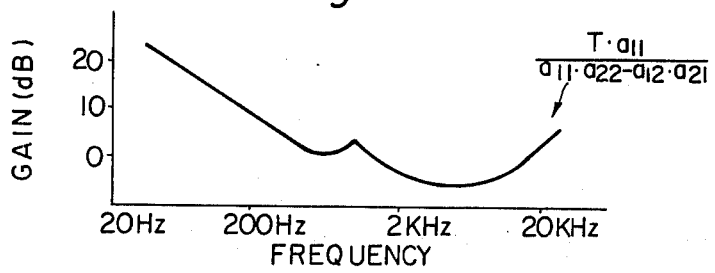
FIG. 3 is a graphic illustration of acoustic transmission characteristics of filter and delay circuits of FIG. 2.
Figure 3B:
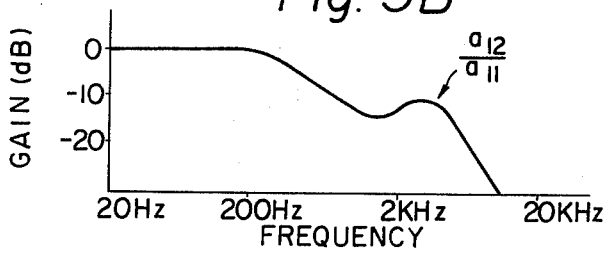

The right and left channel signals are expressed by Equations (6) and (7) are fed into the transducer 5 and will be eventually fed to the right and left loudspeaker 12*f* and 11*f*, respectively. FIGS. 3A and 3B illustrate graphically the transmission characteristic of the filter 20R and the combined characteristic of delay element 21R and filter 22R, respectively, given that the propagation axes of sound waves transmitted from the front left and right loudspeakers 11*f* and 12*f* are inclined at 45° to each other and the listener M is seated at the vertex of a triangle formed by the lines interconnecting the loudspeakers 11*f*, 12*f* and the listener M. Since the listener is seated at equal distances from the loudspeakers 11*f*, 12*f*, the transmission coefficients $a_{11}$ and $a_{22}$, are of roughly equal values, and also $a_{12}$ and $a_{21}$ are substantially of equal values. Therefore, similar transmission characteristic curves may be obtained for the filter 20L and the delay element 21L and filter 22L (the curves of FIGS. 3A and 3B are obtained for a delay time of 0.4 milliseconds over the entire spectrum of frequencies).

Figure 4:
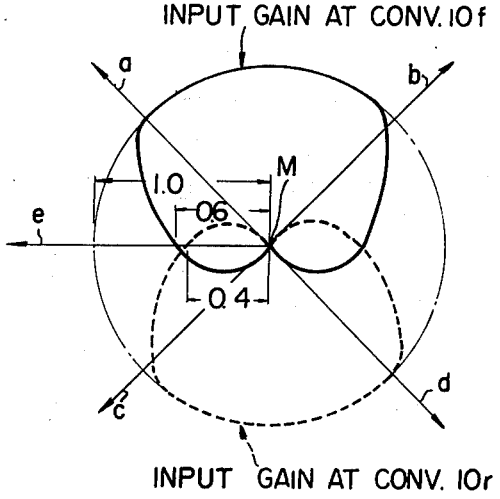
FIG. 4 is a graphic illustration useful for describing the adjustment of variable attenuators employed in the circuit of FIG. 1.

Localization of front sound sources is therefore effected by passing the signals R*s* and L*s* through the front converter 10*f* while suppressing the signals to be converted by the rear converter 10*r*, and the sound waves resulting from the converted signals R*sp* and L*sp* as emitted from the loudspeakers 12*f* and 11*f* produce a binaural effect as if the listener M is seated in the position of the dummy head 2. Localization of rear sound sources which come from the rear of the dummy head 2 is also achieved by allowing the rear converter 10*r* to pass the signals R*s* and L*s* while suppressing the signals to be converted by the front converter 10*f*, with the result that the rear sound waves emitted from rear loudspeakers 11*f* and 12*r* produce a similar binaural effect to the ears of the listener M as if he is seated in the position of the dummy head 2. In FIG. 4, solid-line curve illustrates a pattern of sound level measured when the phantom sound sources are localized in front of the listener M, while broken-line curve illustrates a pattern of sound level measured when the phantom sound sources are localized at the rear of the listener, and "M" denoting the location of the listener and "*a*" and "*b*" designating the lines interconnecting the front left and rear right loudspeakers and the front right and rear left loudspeakers, respectively.

In the embodiment of FIG. 1, it is important to note that the original front and rear sound sources are localized independently from each other on a one-at-a-time basis. Therefore, the original sound sources are not present simultaneously.

Figure 5:
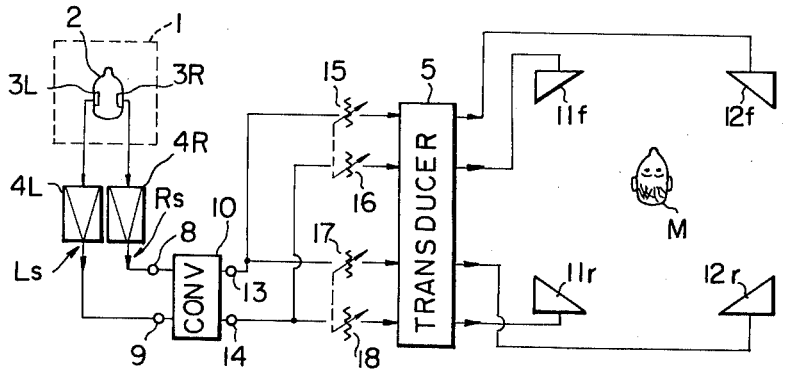
FIG. 5 is a variation of the circuit of FIG. 1.

The attenuators 15 to 18 may be connected between the output of converter 10 and the input to the transducer 5 as illustrated in FIG. 5. In this case, a single converter 10 is commonly used for conversion of the binaural signals R*s* and L*s*, rather than two converters for conversion of front and rear binaural signals.

Figure 6:
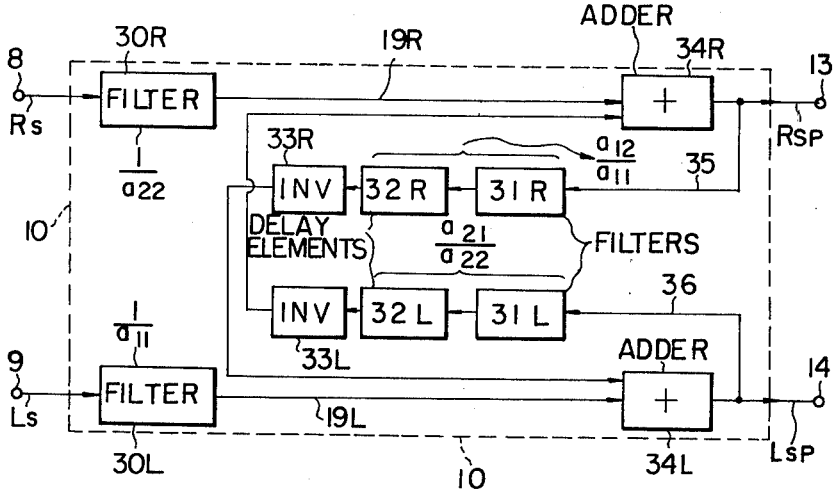
FIG. 6 is a detailed circuit diagram of a modified from of the acoustic crosstalk cancellation circuit.

FIG. 6 shows a modified form of the converter 10 which is derived as follows: From Equation (1), L*sp* and R*sp* can be given by $$\left.\begin{aligned} Lsp &= \frac{1}{a_{11}} Le - \frac{a_{12}}{a_{11}} Rsp \\ Rsp &= \frac{1}{a_{22}} Re - \frac{a_{21}}{a_{22}} Lsp \end{aligned}\right\} \quad (8)$$

The conditions which satisfy that $Le = Ls$ and $Re = Rs$ can be obtained by substituting $Ls$ and $Rs$ for $Le$ and $Re$, respectively, of Equation (8), thereby resulting in Equation (9)

$$\left.\begin{aligned} Lsp &= \frac{1}{a_{11}} Ls - \frac{a_{12}}{a_{11}} Rsp \\ Rsp &= \frac{1}{a_{22}} Rs - \frac{a_{21}}{a_{22}} Lsp \end{aligned}\right\} \quad (9)$$

Figure 7:
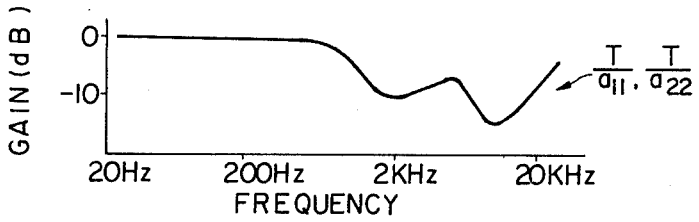
FIG. 7 is a graphic illustration of acoustic transmission characteristic of the filter and delay circuits of FIG. 6.

In FIG. 6, the converter 10 comprises a pair of paths 19R and 19L for right and left channels, respectively, as previously described. A filter 30R having a transmission characteristic $1/a_{22}$ is connected in the right path 19R and a filter 30L having a transmission characteristic $1/a_{11}$ connected in the left path 19L. Adders 34R and 34L are interposed in the right and left paths. A first feedback compensation path 35 is provided between the output of adder 34R and one input terminal of the added 34L, and a second feedback compensation path 36 is provided between the output of adder 34L and one input terminal of the adder 34R. The first compensation path 35 includes a filter 31R, a delay element 32R and an inverter 33R all of which are connected in series. The filter 31R and delay element 32R have a combined transmission characteristic of $a_{12}/a_{11}$ so that the adder 34L provides an output R*sp* which satisfies Equation (9). Similarly, the second compensation path 36 includes a filter 31L, a delay element 32L and an inverter 33L all of which are connected in series to generate a signal L*sp* at the output of added 34L which also satisfies Equation (9). In practice, the filters 30R and 30L are realized by taking into account delay time T so that their characteristics become $T/a_{11}$ and $T/a_{22}$, respectively. FIG. 7 illustrates the transmission characteristics of the filters 30R and 30L on the assumption that the listener M is seated at equal distances from the loudspeakers of interest (front or rear loudspeakers) with the direction of sound wave propagation oriented to the listener, as previously described.

Figure 8:
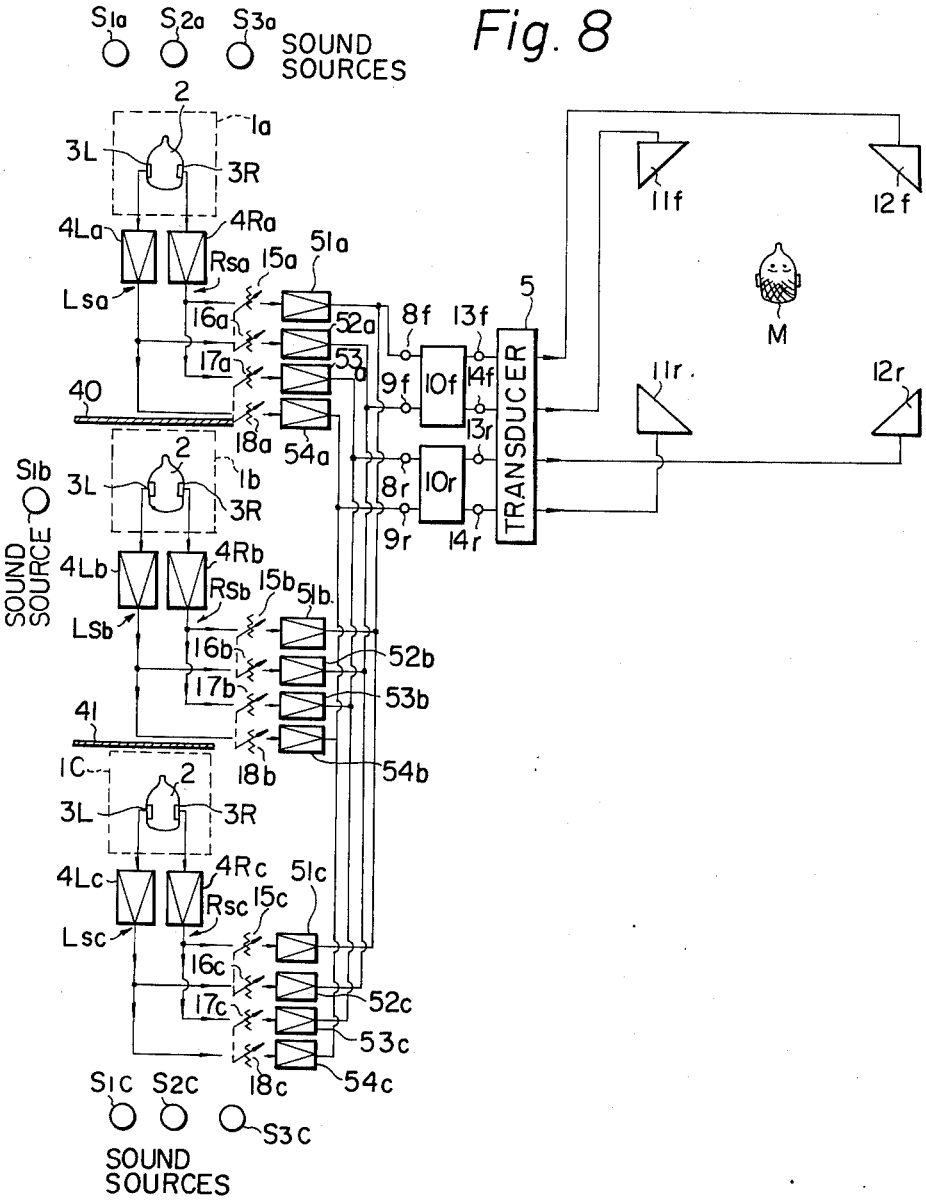
FIG. 8 is a first embodiment of the invention.

FIG. 8 illustrates an embodiment of the present invention which comprises a front sound pickup arrangement 1*a*, a lateral sound pickup arrangement 1*b* and a rear sound pickup arrangement 1*c*, all of which are similar in configuration to that shown in FIG. 1 with the exception that buffer amplifiers 51 to 54 are connected between the attenuators 15 to 18 and the inputs of the converters 10*f* and 10*r* and that the outputs of the buffer amplifiers of the same reference numeral are connected in common to the respective converters in order to provide simultaneous recording of various sound sources. Front sound sources $S_{1a}$, $S_{2a}$ and $S_{3a}$ are located in front of the dummy head 2 of front sound pickup arrangement 1*a*, a lateral sound source $S_{1b}$ to the left of the dummy head of arrangement 1*b*, and rear sound sources $S_{1c}$, $S_{2c}$ and $S_{3c}$ at the rear of the arrangement 1*c*. These sound pickup arrangements are acoustically isolated by means of partitions 40 and 41 schematically illustrated. In the illustrative embodiment of FIG. 8 attenuators 15*a*, 16*a* are adjusted to provide a maximum input gain for converter 10*f*, while attenuators 17*a* and 18*a* are adjusted to provide a minimum input gain for converter 10*r*. Likewise, attenuators 17*c*, 18*c* are adjusted to provide a maximum input gain for converter 10*r*, while attenuators 15*c*, 16*c* are adjusted to provide a minimum input gain for converter 10*r*. It will be understood that if the front and rear sound sources are permanently associated with the pickup arrangements 1*a* and 1*c*, respectively, attenuators 15*a* to 18*a* and 15*c* to 18*c* as well as buffer amplifiers 53*a*, 54*a*, 51*c* and 52*c* can be dispensed with. Atenuators 15*b* to 18*b* are adjusted in a manner as previously described in connection with FIG. 4. Therefore, the converter 10*f* receives binaural signals representing the frontal components of the overall signal through buffer amplifiers 51*a*, *l* 52*a* and 51*b* and 52*b*, whereas the converter 10*r* receives binaural signals representing the rearward components of the overall signal through buffer amplifiers 53*b*, 54*b* and 53*c* and 54*c*. All the binaural signals passing through the converters are recorded by the four-channel transducer 5 in a known manner or transmitted through a communication medium to a receiving end where loudspeakers 11*f* to 12*r* are provided.

Figure 9:
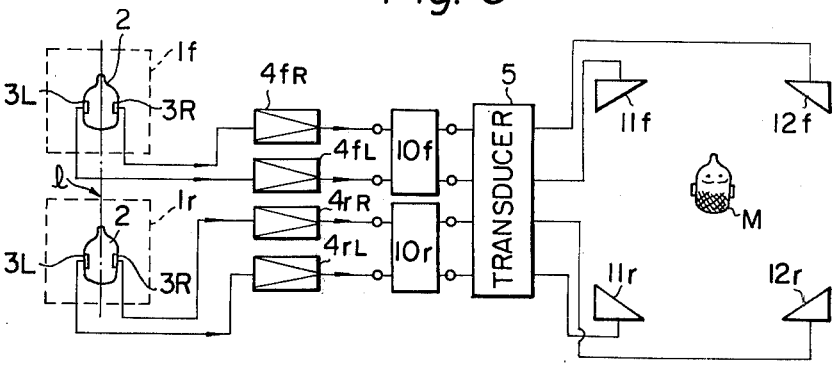
FIG. 9 is a second embodiment of the invention.

In FIG. 9, there is shown a second embodiment of the present invention which comprises a front sound pickup arrangement 1*f* and rear sound pickup arrangement 1*r* located at a predetermined spacing behind the front pickup arrangement 1*f* in the same sound field. Each of the arrangements comprises a dummy head 2 and right and left microphones 3R and 3L mounted within the dummy as in the previous embodiment. The dummy heads 2 of both pickup arrangements have equal dimensions and shapes, are supported at the same height from the floor level and have their faces oriented in the same direction with their noses exactly aligned along a line "l" which bisects both dummy heads. The front pickup arrangement 1*f* is used to primarily collect sound signals from front sound sources and feeds the front speakers 11*f* and 12*f* through front converter 10*f* and transducer 5, while the rear pickup arrangement 1*r* is used to primarily collect signals from rear sound sources located at the rear end of the rear pickup arrangement 1*r* to feed the rear speakers 11*r* and 12*r* through rear converter 10*r* and transducer 5. Amplifiers 4*f*R and 4*f*L are connected between the microphones 3R, 3L of front pickup arrangement 1*f* and the input terminals of converter 10*f* to provide amplification of the front binaural signals. Similarly, amplifiers 4*r*R and 4*r*L are provided between the microphones 3R, 3L of rear pickup arrangement 1*r* and the input terminals of rear converter 10*r* to provide amplification of the rear binaural signals. Front and rear binaural effects are thus reproduced through front and rear channels. A lateral sound source, if present, is picked up by front and rear pickup arrangements 1*f* and 1*r* and reproduced through respective channels.

Figure 10:
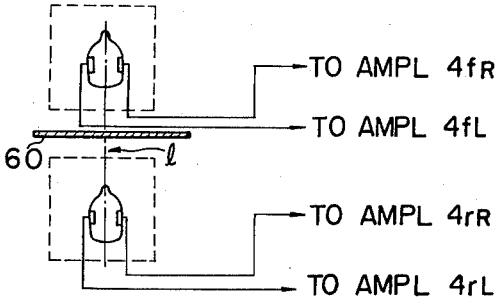
FIG. 10 is a modification of the second embodiment.

A partition 60 may be provided between the front and rear sound pickup arrangements as illustrated in FIG. 10. The effect of the partition 60 is to provide a certain degree of isolation between the front and rear sound sources so that the listener M is able to clearly distinguish therebetween. The dummy heads 2 are preferably provided with earlaps since they enhance the degree of distinctness between the front and rear sound sources.

An experiment showed that each sound source or group of sound sources can be localized between adjacent ones of the four speakers and thus the binaural effect as produced by a closed-circuit type binaural sound reproducing system are simulated without the inconvenience and disadvantages of the prior art system.

What is claimed is:

1. A four-channel stereophony using left and right front loudspeakers and left and right rear loudspeakers, comprising:

first and second dummy heads each simulating the human head in shape and dimensions and provided with left and right microphones mounted in positions corresponding to the ears of the human head to generate front binaural signals L*fs* and R*fs* from the first dummy head and second binaural signals L*rs* and R*rs* from the second dummy head;

means comprising a first crosstalk cancellation circuit connected to the microphones of the first dummy head for converting the first binaural signals into third binaural signals L*fsp* and R*fsp* such that said third binaural signals have the following relations to the first binaural signals:

$$\begin{bmatrix} Lfsp \\ Rfsp \end{bmatrix} = T \begin{bmatrix} a_{11} & a_{12} \\ a_{21} & a_{22} \end{bmatrix}^{-1} \begin{bmatrix} Lfs \\ Rfs \end{bmatrix}$$

where, T is a delay time, $a_{11}$ and $a_{12}$ are acoustic transmission characteristics over the path between the left front loudspeaker and the left and right ears, respectively, of a listener; and $a_{21}$ and $a_{22}$ are acoustic transmission characteristics over the path between the right front loudspeaker and the left and right ears, respectively, of the listener;

means comprising a second crosstalk cancellation circuit connected to the microphones of the second dummy head for converting the second binaural signals into fourth binaural signals L*rsp* and R*rsp* such that said fourth binaural signals have the following relations to the second binaural signals:

$$\begin{bmatrix} Lrsp \\ Rrsp \end{bmatrix} = T \begin{bmatrix} b_{11} & b_{12} \\ b_{21} & b_{22} \end{bmatrix}^{-1} \begin{bmatrix} Lrs \\ Rrs \end{bmatrix}$$

where, $b_{11}$ and $b_{21}$ are acoustic transmission characteristics over the path between the left rear loudspeaker and the left and right ears, respectively, of the listener; and $b_{12}$ and $b_{22}$ are acoustic transmission characteristics over the path between the right rear loudspeaker and the left and right ears, respectively, of the listener; and four-channel transducing means connected to the outputs from the first and second crosstalk cancellation circuit for translating the third and fourth binaural signals into reproduceable form; whereby said third and fourth binaural signal, when electroacoustically reproduced, will produce front and rear binaural effects, respectively, to said listener.

2. A four-channel stereophony as claimed in claim 1, wherein said first and second dummy heads are oriented in the same direction with the second dummy head being located behind the first dummy head.

3. A four-channel stereophony as claimed in claim 2, further comprising a partition provided between said first and second dummy heads to provide an acoustical separation of sound field.

4. A four-channel stereophony as claimed in claim 2, wherein said first and second dummy heads have their noses aligned to a line bisecting the first and second dummy heads.

5. A four-channel stereophony as claimed in claim 2, wherein each of said first and second crosstalk cancellation circuits comprises a first channel connected at one end to the microphone mounted in the position corresponding to the right ear of the human head and at the opposite end to said transducing means, a second channel connected at one end to the microphone mounted in the position corresponding to the left ear of the human head and at the opposite end to the transducing means, first filter means connected in the first channel, second filter means connected in the second channel, a first adder having a first input terminal and an output terminal connected in the first channel to receive at the first input terminal the output from said first filter means, a second adder having a first input terminal and an output terminal connected in the second channel to receive at the first input terminal the output from said second filter means, first delay-and-filter means and first inverting means connected in series between the output of said first filter means and a second input terminal of the second adder, and second delay-and-filter means and second inverting means connected in series between the output of the second filter means and a second input terminal of the first adder.

6. A four-channel stereophony as claimed in claim 2, wherein each of said first and second crosstalk cancellation circuits comprises a first channel connected at one end to said right microphones and at the opposite end of said transducing means, a second channel connected at one end to the said left microphones and at the opposite end to said transducing means, first filter means connected in the first channel, second filter means connected in the second channel, a first adder having a first input terminal and an output terminal connected in the first channel to receive at the first input terminal the output from said first filter means, a second adder having a first input terminal and an output terminal connected in the second channel to receive at the first input terminal the output from said second filter means, first delay-and-filter means and first inverting means connected in series between the output terminal of the first adder, and second delay-and-filter means and second inverting means connected in series between the output terminal of the second adder and a second input terminal of the first adder.

7. A four-channel stereophony using two front and two rear loudspeakers, comprising:

first, second and third dummy head each simulating the human head in shape and dimensions and provided with microphones mounted in positions corresponding to the right and left ears of the human head to pick up front, lateral and rear sound sources, respectively;

a first crosstalk cancellation circuit connected to the microphones of the first and second dummy heads to generate first binaural signals which when electroacoustically reproduced through said front loudspeakers will produce a front binaural effect to a listener positioned in the sound field of said front and rear loudspeakers;

a second crosstalk cancellation circuit connected to the microphones of the second and third dummy heads to generate second binaural signals which when electroacoustically reproduced through said rear loudspeakers will produce a rear binural effect to said listener;

variable attenuators each connected between the microphones of the second dummy head and the first and second crosstalk cancellation circuits to provide adjustment of the signals applied to the first and second cancellation circuits relative to each other; and four-channel transducing means connected to the outputs from the first and second crosstalk cancellation circuits for transducing the first and second binaural signals in reproduceable form.

8. A four-channel stereophony as claimed in claim 7, wherein said first, second and third dummy heads are acoustically isolated from each other.

9. A four-channel stereophony as claimed in claim 7, further comprising buffer amplifiers each connected between each of said variable attenuators and said first and second crosstalk cancellation circuits.

10. A four-channel stereophony as claimed in claim 7, wherein each of said first and second crosstalk cancellation circuits comprises a first channel connected at one end to the microphone mounted in the position corresponding to the right ear of the human head and at the opposite end to said transducing means, a second channel connected at one end to the microphone mounted in the position corresponding to the left ear of the human head and at the opposite end to the transducing means, first filter means connected in the first channel, second filter means connected in the second channel, a first adder having a first input terminal and an output terminal connected in said first channel to receive at the first input terminal the output from said first filter means, a second adder having a first input terminal and an output terminal connected in the second channel to receive at the first input terminal the output from said second filter means, first delay-and-filter means and first inverting means connected in series between the output of said first filter means and a second input terminal of the second adder, and second delay-and-filter means and second inverting means connected in series between the output of the second filter means and a second input terminal of the first adder.

11. A four-channel stereophony as claimed in claim 7, wherein each of said first and second cross-talk cancellation circuits comprises a first channel connected at one end to the microphone mounted in the position corresponding to the right ear of the human head and at the opposite end to said transducing means, a second channel connected at one end to the microphone mounted in the position corresponding to the left ear of the human head and at the opposite end to said transducing means, said first filter means connected in the first channel, second filter means connected in the second channel, a first adder having a first input terminal and an output terminal connected in the first channel to receive at the first input terminal the output from said first filter means, a second adder having a first input terminal and an output terminal connected in the second channel to receive at the first input terminal the output from said second filter means, first delay-and-filter means and first inverting means connected in series between the output terminal of the first adder and a second input terminal of the second adder, and second delay-and-filter means and second inverting means connected in series between the output terminal of the second adder and a second input terminal of the first adder.

* * * * *